US005595202A

United States Patent [19]

Scaccia

[11] Patent Number: 5,595,202

[45] Date of Patent: Jan. 21, 1997

[54] UMBRELLA TEAR PREVENTION AND REPAIR DEVICE

[76] Inventor: David M. Scaccia, 171 Eastwood Ave., Deer Park, N.Y. 11729

[21] Appl. No.: 490,940

[22] Filed: Jun. 15, 1995

[51] Int. Cl.[6] ..... A45B 25/04

[52] U.S. Cl. ..... 135/33.6; 135/33.5; 135/33.2; 135/33.4; 135/44

[58] Field of Search ..... 135/33.5, 33.2, 135/33.4, 33.6, 44

[56] References Cited

U.S. PATENT DOCUMENTS

| | | | |
|---|---|---|---|
| 2,185,587 | 1/1940 | Carlisle | 135/33.5 |
| 2,582,749 | 1/1952 | December | 135/33.5 |
| 2,591,095 | 4/1952 | Ornstein et al. | 135/33.5 |
| 2,624,357 | 1/1953 | Cutrone et al. | 135/33.5 X |
| 2,625,947 | 1/1953 | Ferrante | 135/33.5 |
| 2,784,727 | 3/1957 | Fleischer | 135/33.5 |
| 4,061,154 | 1/1977 | Cox et al. | 135/33.5 |
| 4,089,416 | 5/1978 | Sims . | |
| 4,232,693 | 11/1980 | Matsuda | 135/33.2 |
| 5,101,844 | 4/1992 | Morrone | 135/33.5 |

*Primary Examiner*—Wynn E. Wood
*Attorney, Agent, or Firm*—Daniel L. Gobetz

[57] ABSTRACT

The present invention relates to a device for securing umbrella material to an umbrella rib end. The device includes a cap member having an external wall and an internal wall, the internal wall defining an internal bore having an opening at a distal of the internal wall; a pair of cooperating jaw members pivotally attached to one another, the jaw members have opposing gripping portions, the jaw members movable between an open position in which the gripping portions are spaced from one another and a closed position in which the gripping portions are approximated; and a flexible cord slidably secured through the cap member, the cap member connected at one end to one of the jaw members and at the other end to the other jaw member.

16 Claims, 2 Drawing Sheets

UMBRELLA TEAR PREVENTION AND REPAIR DEVICE

BACKGROUND OF THE INVENTION

1. Field of the Invention

The present invention relates generally to devices for repairing umbrellas, and for preventing the tearing of umbrellas. More particularly, the present invention relates to a device for securing the umbrella material to the end of the umbrella ribs.

2. Description of the Prior Art

Due to the structural designs of umbrellas, an inherent weak spot is the point in which the lining material of the umbrella is secured to the rib ends of the umbrella. Inevitably, through use in high winds and other foul weather, the material located at or near the in ends tears away from the rib and rib ends from which they are attached. As any umbrella user can attest to, once the umbrella lining develops a tear, the use of the umbrella becomes increasing difficult and downright annoying as the tear spreads, the umbrella rib ends become exposed hazards, not to mention the unsightly nature of a ragged umbrella. As a result of these common problems with umbrellas, many devices have been created in an attempt to prevent the tearing of umbrellas, and to repair an already damaged umbrella.

Some of the early patents which disclose repair devices are U.S. Pat. Nos. 1,007,320, 1,060,712, and 1,336,218. Unfortunately, the devices disclosed in these patents require special devices or tools to secure the umbrella lining material to the rib ends.

A more recent device is described in U.S. Pat. No. 4,089,416 to Sims wherein an umbrella repair kit can be used to repair torn umbrella material. The kit includes a short section of plastic tube, and a conical cap having a threaded bore. The plastic tube is designed to be expanded over the tip end of the umbrella rib, then a section of the umbrella material is placed over and around the tube, and finally the conical cap is manually screwed over the tube to hold the material in place on the end of the umbrella tip. This device has two inherent weaknesses, the first being that two pieces, namely the tube and the cap, must be used two to repair the umbrella. Inevitably, one piece will be lost, misplaced or damaged rendering the remaining piece useless. Secondly, and of greatest concern, this device can only be employed if torn material can be draped over the rib end of the umbrella. Unfortunately, most of the time it is the material that is in closest proximity to the rib end which has torn away or is in the worst condition. When the material surrounding the rib end is missing or in poor condition, it cannot be effectively draped over the rib end to secured the remaining material to the rib ends to repair the umbrella.

Further development of umbrella repair devices can be seen as described in U.S. Pat. No. 5,101,844 to Morrone. Morrone 844' discloses a device for preventing and repairing tears in the umbrella material adjacent the rib ends. The Morrone device is preferably made of plastic and which can be fitted or clamped over the ribs of the umbrella to additionally secure the ribs to the umbrella material. Although this device is one piece in construction, it suffers from the same deficiency as the Sims device described above in that it requires the provision that material of reasonably quality be available adjacent to the rib and rib ends of the umbrella. As mentioned above, it is generally this material which has been torn away or otherwise severely damaged making rendering this device ineffective in repairing an umbrella. This device, to its credit, can be applied to a new or undamaged umbrella as an effective means of preventing tears. However, human nature makes it unlikely that a consumer will take the time out to place such a device on an undamaged umbrella, but rather will desperately search for a quick an easy device to repair the umbrella at the time the umbrella tears.

It is therefore an object of the present invention to provide an umbrella repair device which is one piece in construction.

It is a further object of the present invention to provide a device which does not require the use of any tools or instruments to be used.

Another object of the present invention is to provide an umbrella repair device which can be used on umbrellas where the umbrella material adjacent to the rib ends is missing or severely damaged.

It is yet another object of the present invention to provide an umbrella repair device which can be quickly an easily attached to an umbrella.

Numerous innovations for umbrella repair devices have been provided in the prior art. Even though these innovations may be suitable for the specific individual purposes to which they address, they differ from the present invention as hereinafter contrasted.

SUMMARY OF THE INVENTION

The present invention includes a device for repairing or preventing tears in umbrellas. The device generally includes a plastic cap member having an external wall and an internal wall. The internal wall defines an internal bore having an opening at a distal end of the internal bore. The internal bore is dimensioned and adapted to receive a portion of a rib end of an umbrella snugly therein. At least one flexible cord is provided, each cord extends through transverse holes in the cap and is attached at both ends to a jaw assembly. Each jaw assembly has a pair of cooperating jaw members having a gripping portion which is adapted to grip umbrella material. The jaw members are pivotally attached to one another and are movable between an open position in which the gripping portions of the jaw members are spaced from one another and a closed position wherein the gripping portions are approximated. The jaw members are configured to be manually moved between the open and closed position to be releasably attached to torn umbrella material. The flexible cord can be stretched to extend the jaw members to material not immediately adjacent to the umbrella ribs or rib ends.

The novel features which are considered characteristic for the umbrella repair device are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

FIRST EMBODIMENT

10—umbrella repair device
12—cap
14—cord
16—jaw assembly
18—bore

20—opening
22—ridges
24—transverse holes
26—jaw members
28—fastener
30—proximal end
32—pivot pin
34—gripping portion
90—umbrella
92—material
94—rib
96—rib ends
98—torn portion

SECOND EMBODIMENT

110—umbrella repair device
112—cap
114A—proximal cord
114B—distal cord
116A—proximal jaw assembly
116B—distal jaw assembly
194—rib
198—torn material

BRIEF DESCRIPTION OF THE PREFERRED EMBODIMENTS

DETAILED DESCRIPTION OF THE PREFERRED EMBODIMENT

Figure 1:
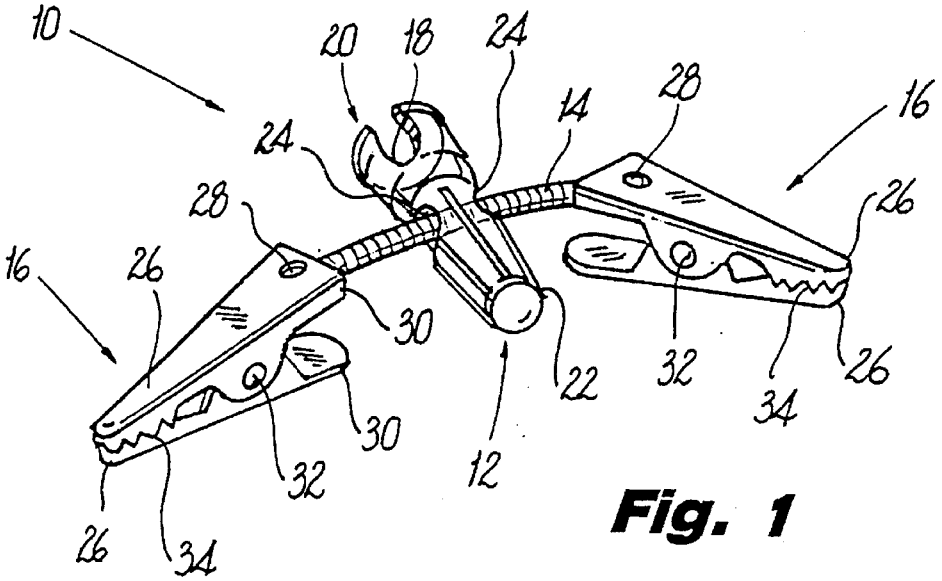
FIG. 1 is a perspective view of an umbrella repair device constructed in accordance with a preferred embodiment of the present invention.

Firstly, referring to FIG. 1, umbrella repair device 10 is shown and includes three main structural elements, namely cap 12, cord 14 and jaw assemblies 16.

With continued reference to FIG. 1, cap 12 is preferably constructed of a polymeric material such as transparent plastic shown. However, it is contemplated that the cap be nontransparent, as well as colored to reflect and match the umbrella lining material. Cap 12 defines an internal bore 18 having an opening 20. Opening 20 is dimensioned to receive a portion of an umbrella rib end therethrough. Ridges 22 extend from the exterior surface of the cap 12 and are adapted to provide a surface which a user can hold to manipulate the device 10. Transverse holes 24 extend through the cap 12 and are dimensioned to permit cord 14 to slide therethrough.

Referring once again to FIG. 1, each jaw assembly 16 has a pair of jaw member 26. Fastener 28 is disposed through the proximal end 30 of one of the jaw members 26 to secure the jaw member 26 to the end of the cord 14. The jaw members 26 are pivotally attached to one another by pivot pin 32. Each jaw member 34 forms a gripping portion 34 adapted to secure umbrella material therebetween when approximated.

Figure 2:
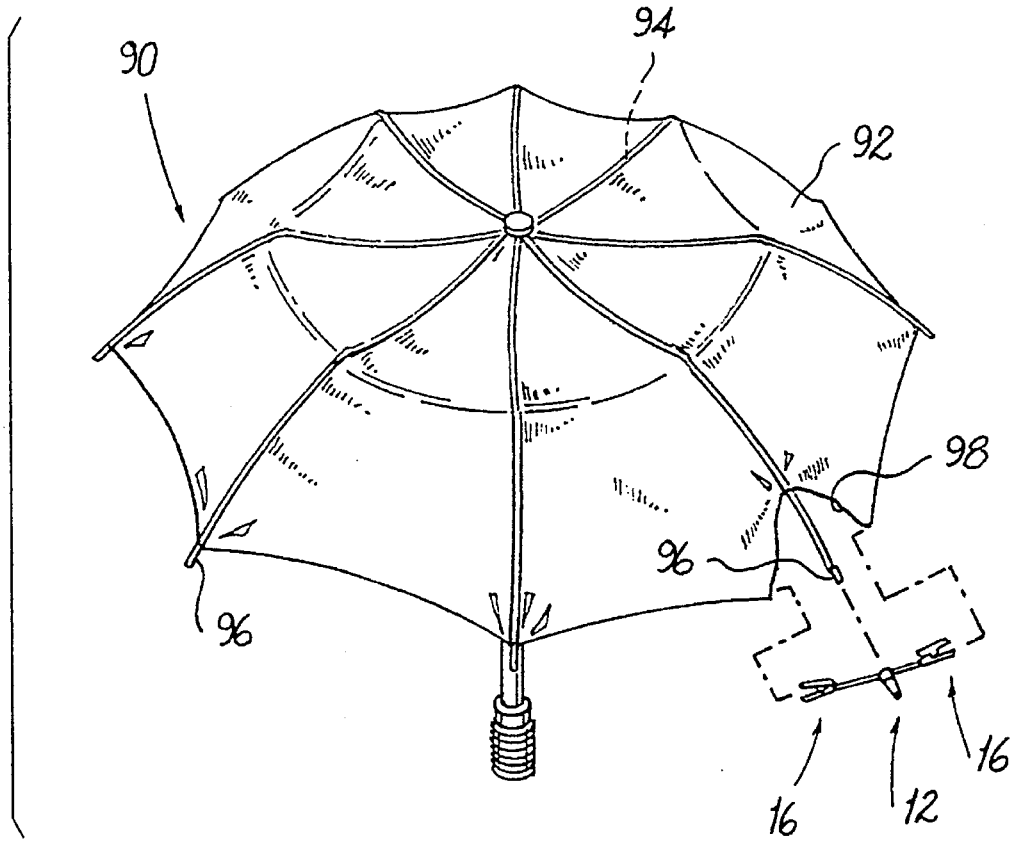
FIG. 2 is a perspective view of an umbrella illustrating torn material.

Referring now to FIG. 2 in conjunction with FIG. 1, umbrella 90 is shown. Umbrella 90 represents a conventional umbrella and includes a fabric material 92 attached to a plurality of spaced apart ribs 94. Each of the ribs 94 terminates at a pointed rib end 96. As shown in FIG. 2, umbrella 90 has a torn portion 98 in material 92 as commonly experienced in umbrellas in general. Umbrella repair device 10 is shown in proximity of the torn portion 98 to illustrate that cap 12 is configured to be placed on the rib end 96 and that the jaw assemblies 16 are configured to be secured to the torn portion 98.

Figure 3:
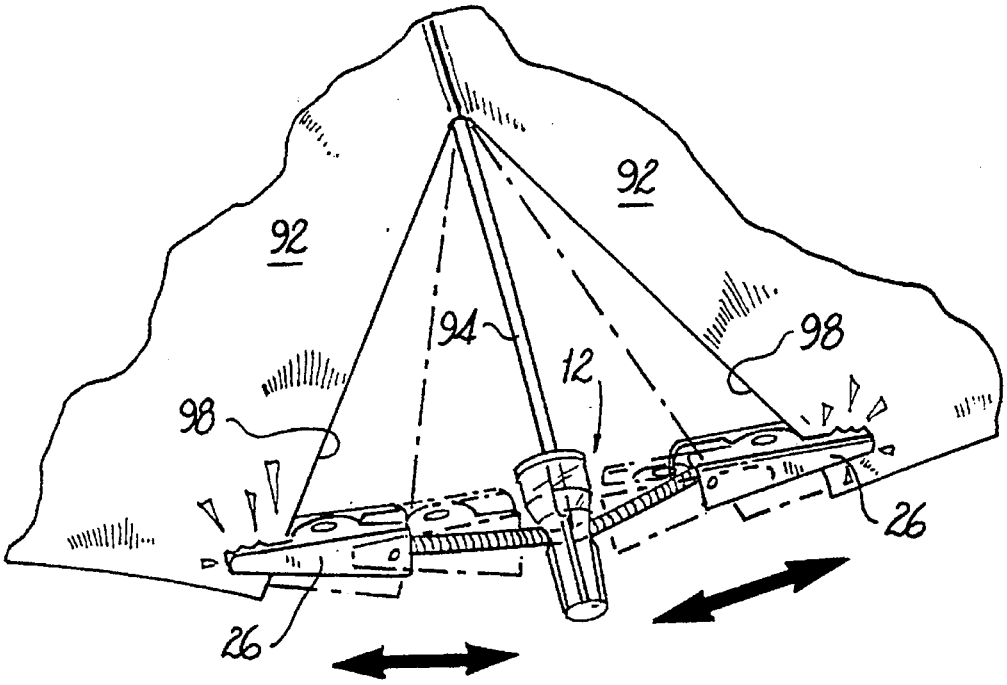
FIG. 3 is a partial perspective view of the umbrella of FIG. 2 illustrating the device of FIG. 1 attached thereto.

Referring now to FIG. 3 in conjunction to FIGS. 1 and 2, the operation of the umbrella repair device 10 will now be described. Rib end 96 disposed between torn portions 98 in material 92 is inserted into the bore 18 in cap 12 through opening 20. Rib end 96 fictionally secured within cap 12 by the internal walls (not shown) of cap 12. Jaw assemblies 26 are then moved by the user toward the torn portions 98 by stretching the cord 14. Once positioned by the user, the jaw assembly is moved into an open position by approximating the proximal ends 30 of the jaw members 29. As the proximal ends 30 are approximated, the gripping portions 34 of the jaw members are increasingly spaced from one another. The user then inserts a portion of the torn portion 98 between the spaced gripping portions 34 of the jaw members 26. The user then releases the tension of the proximal ends 30 of the jaw members 26 allowing the the jaw assembly to return to its resting position with the gripping portions 34 of the jaw members 16 firmly approximated with a portion of the torn portion 98 secured therebetween. The user then repeats this process for the other jaw assembly 16 on another portion of the torn portion 98 of the material 92. After both jaw assemblies 16 have been secured to the torn portion 98 of the material 92, the user releases the device 10. The elasticity of the cord 14 applying a force on the torn portion 98 toward the cap 12 and repairing the umbrella 90.

Figure 4:
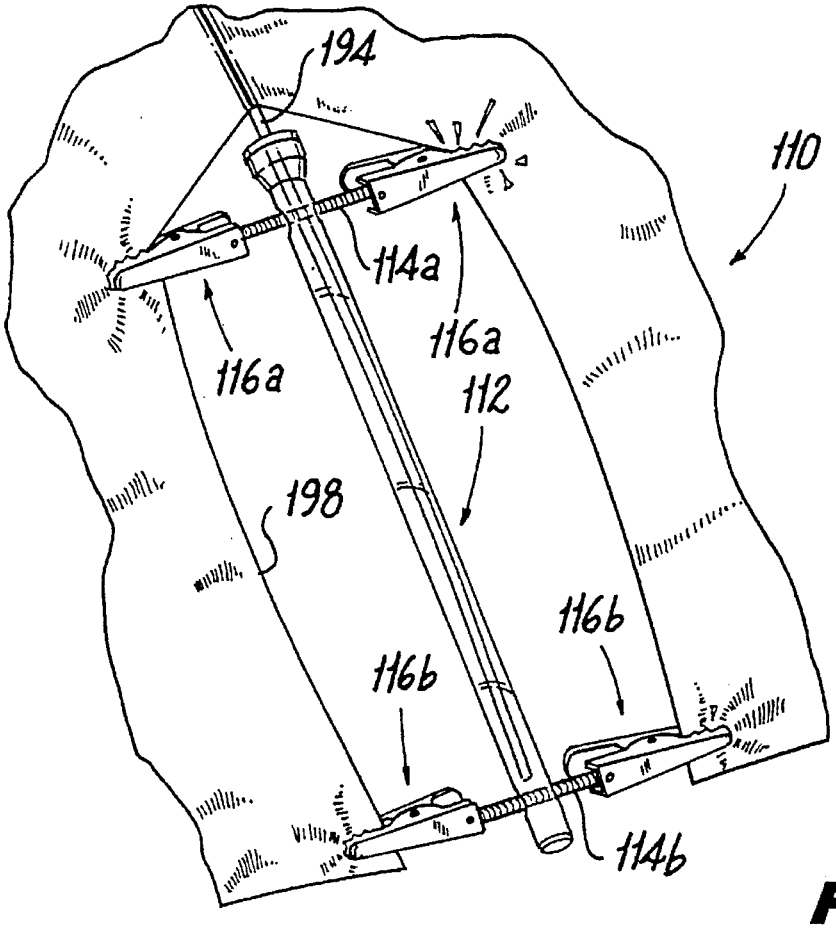
FIG. 4 is view similar to that of FIG. 3 illustrating an umbrella device constructed in accordance with a second embodiment of the present invention being attached to a umbrella.

Referring to FIG. 4, an umbrella repair device 110 constructed in accordance with a second embodiment of the present invention is shown. Device 110 is similar to construction and use as device 10 and includes an elongated cap 112. Secured to cap 112 is proximal cord 114A and a distal cord 114B. Attached in the same manner as described above with respect to device 10, are jaw assemblies 116A and 116B respectively attached to cords 114A and 114B. The operation of the device 110 is similar to that of device 10 with the jaw assemblies 116A and 116B being moved to different portions of the torn portion 198 by stretching cords 114A and 114B. The jaw assemblies 116A and 116B are then attached to the torn material 198 to resecure the torn portion 198 to the ribs 194 and repair the umbrella 90.

While the invention has been illustrated and described as embodied in an umbrella repair device, it is not intended to be limited to the particular structure disclosed herein, since it will be understood that various omissions, modifications, substitutions and changes in the forms and details of the device illustrated and in its operation can be made by those skilled in the art without departing in any way from the spirit of the present invention. For example, it is envisioned that the device can be secured to an umbrella prior to damage to the umbrella to prevent tearing in the material.

I claim:

1. A device for securing umbrella material to an umbrella rib end, which comprises:

a) a cap member having an external wall and an internal wall, the internal wall defining an internal bore having an opening at a distal end of the internal wall;

b) attachment means for releasably securing the device to the umbrella material;

c) at least one cord connected to the cap member and the attachment means for securing the cap member to the attachment means;

d) wherein the at least one cord has a minimum length at a resting position and a maximum length at an extended position, the at least one cord moveable between the resting position and the extended position, the at least one cord biased towards the resting position.

2. The device as described in claim 1 wherein the attachment means includes at least one jaw assembly.

3. The device as described in claim 2, wherein the at least one jaw assembly comprises a pair of cooperating jaw members having opposing gripping portions, the jaw members pivotally attached to one another and movable between an open position in which the gripping portions are spaced from one another and a closed position in which the gripping portions are approximated.

4. The device as described in claim 3 wherein the cap member is constructed from a polymeric material, the material being transparent.

5. The device as described in claim 1 wherein the at least one cord comprise an elastic cord having a first end and a second end, at least the first end connected to the attachment means.

6. The device as described in claim 5, wherein the attachment means comprises a first jaw assembly attached to the first end of the cord and a second jaw assembly attached to the second end of the cord.

7. The device as described in claim 1 wherein cap member has at least one ridge member formed thereon to assist the user in grasping the cap member.

8. A device for securing umbrella material to an umbrella rib end, which comprises:

a) a cap member having an external wall and an internal wall, the internal wall defining an internal bore having an opening at a distal end of the internal wall;

b) at least one jaw assembly;

c) at least one cord connected to the cap member and the at least one jaw assembly;

d) wherein the at least one cord has a minimum length at a resting position and a maximum length at an extended position, the at least one cord moveable between the resting position and the extended position, the at least one cord biased towards the resting position.

9. The device as described in claim 1 wherein the at least one cord is a single cord having a first end and a second end, at least the first end connected to the at least one jaw assembly.

10. The device as described in claim 9 wherein the at least one jaw assembly is a first jaw assembly attached to the first end of the cord and a second jaw assembly attached to the second end of the cord.

11. The device as described in claim 10, wherein the first and second jaw members are pivotally attached to one another and have opposing gripping portions.

12. The device as described in claim 10 wherein the first and second jaw members are movable between an open position in which the gripping portions are spaced from one another and a closed position in which the gripping portions are approximated.

13. The device as described in claim 8 wherein the cap member is constructed from a polymeric material, the material being transparent.

14. The device as described in claim 8 wherein cap member has at least one ridge member formed thereon to assist the user in grasping the cap member.

15. A device for securing umbrella material to an umbrella rib end, which comprises:

a) a cap member having an external wall and an internal wall, the internal wall defining an internal bore having an opening at a distal end of the internal wall;

b) a pair of cooperating jaw members pivotally attached to one another, the jaw members have opposing gripping portions, the jaw members movable between an open position in which the gripping portions are spaced from one another and a closed position in which the gripping portions are approximated; and c) a flexible cord slidably secured through the cap member, the flexible cord connected at one end to one of the jaw members and at the other end to the other jaw member.

16. The device as described in claim 15 wherein the cord has a minimum length at a resting position and a maximum length at an extended position, the cord moveable between the resting position and the extended position, the cord biased towards the resting position.

* * * * *